United States Patent [19]

Akiyoshi

[11] 3,991,295

[45] Nov. 9, 1976

[54] MICROWAVE OVEN WITH SYMMETRICALLY POSITIONED MICROWAVE STIRRERS

[75] Inventor: Mitsuo Akiyoshi, Koriyama, Japan

[73] Assignee: Matsushita Electric Industrial Co., Ltd., Japan

[22] Filed: Apr. 29, 1975

[21] Appl. No.: 572,702

[30] Foreign Application Priority Data

May 20, 1974 Japan ..... 49-57945[U]
May 23, 1974 Japan ..... 49-59615[U]
May 23, 1974 Japan ..... 49-58585

[52] U.S. Cl. ..... 219/10.55 F
[51] Int. Cl.² ..... H05B 9/06
[58] Field of Search ..... 219/10.55 F, 10.55 R, 219/10.55 D

[56] References Cited

UNITED STATES PATENTS

| | | | |
|---|---|---|---|
| 3,364,332 | 1/1968 | Reftmark | 219/10.55 F |
| 3,370,145 | 2/1968 | Malmquist | 219/10.55 F |
| 3,626,136 | 12/1971 | Funahashi | 219/10.55 F |
| 3,783,219 | 1/1974 | Tateda | 219/10.55 D |

FOREIGN PATENTS OR APPLICATIONS

| | | | |
|---|---|---|---|
| 47,232 | 1/1972 | Japan | 219/10.55 F |

*Primary Examiner*—Arthur T. Grimley
*Attorney, Agent, or Firm*—Wenderoth, Lind & Ponack

[57] ABSTRACT

A microwave oven in which the heating chamber is defined by an upper portion serving as a door opening upwards and a lower portion forming the oven chamber lower portion for constituting, upon closure of the door, one complete heating chamber, in one side of which heating chamber, microwave assembly and stirrer members are advantageously incorporated for simplification of the heating chamber construction and compact size of the oven, with the stirrer members which are rotated by the passage of cooling air thereover being disposed in positions symmetrical with respect to the central vertical axis of the heating chamber for efficient microwave energy distribution and consequent uniform heating of the object to be heated.

7 Claims, 8 Drawing Figures

MICROWAVE OVEN WITH SYMMETRICALLY POSITIONED MICROWAVE STIRRERS

Figure 1:
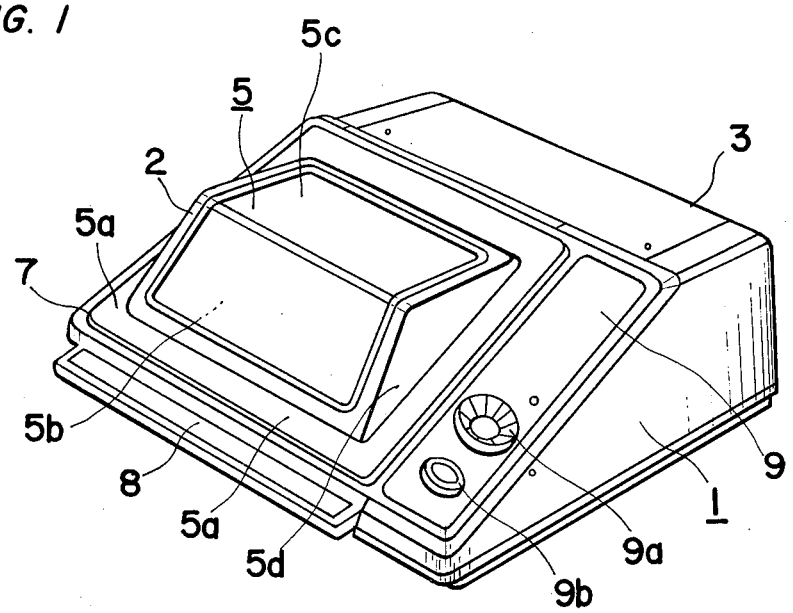

The present invention relates to a microwave oven, and more particularly to a microwave oven which has a compact and economical structure with efficient microwave stirrer means incorporated therein.

There is known and commonly employed a type of oven which is generally termed a microwave oven and which makes use of the heating effects of microwaves, produced for example, by a magnetron located in a housing adjacent to a casing defining the heating chamber or oven chamber, and supplied into the oven chamber.

The conventional microwave oven of the above described type is provided either with a door which is hinged along a side and swings open sideways, or a door which is hinged along a bottom edge and swings open downwards, while the microwave assembly including the magnetron and the stirrer means of the microwave energy are disposed in the upper portion of the heating chamber, which conventional type of microwave ovens, though suited to employment as portable ovens, have various disadvantages. One disadvantage is that it becomes difficult to use the oven in a comparatively restricted space since allowance must be made to permit the door to swing open. Another disadvantage is that a portable oven is inevitably subjected to a certain amount of jolting or other action liable to result in an imperfect fit of the moving parts of the oven, and the principal moving part of the oven is the door, which must be retained in a closed position solely by catch means, since its weight does not act to retain it in a closed position. In other words, in the conventional means there is no naturally acting force which tends to counter any imperfection of the fitting of a door after a certain amount of displacement of the oven. This is particularly disadvantageous for an oven employing microwaves as the mode of heating, not only from the point of view of poor economy due to lost heat, but also because of the possibility of leakage of microwaves which can be hazardous to a person using the oven. Another disadvantage, which relates to convenience of use of an oven, is that the support that may be available for a portable oven can be by no means guaranteed to be such that the oven is at an optimum level for use. In particular, if the oven can only be supported on the ground, or at a low level, it becomes extremely difficult to insert or remove an object or food to be heated into or from the oven or to inspect the object therein.

In order to overcome such disadvantages, a microwave oven having a door which opens upwards has been conceived, which microwave oven is very convenient to use, since such a door opening upwards does not extend toward the user during the opening or closing thereof. Furthermore, when the door of the above described type is opened, the upper portion of the heating chamber is free of any obstacles, so that it is unnecessary to withdraw the object being heated from the heating chamber whenever the condition of the object during cooking is to be examined.

However, no microwave oven having a door which opens upwards has been put into practical use, although such a microwave oven is known to be convenient to use, easy to operate and compact in size, because in the microwave oven of the above of the above described type, the microwave assembly must inevitably be disposed at the side or in the lower portion of the heating chamber, so that incorporation of efficient microwave stirrer means of simple construction in the oven for uniformity heating the object to be cooked becomes extremely difficult.

Accordingly, an essential object of the present invention is to provide a microwave oven which is provided with a door opening upwards and which is consequently convenient to use, easy to operate and compact in size with substantial elimination of the disadvantages inherent in the conventional microwave ovens.

Another important object of the present invention is to provide a microwave oven of the above described type in which a microwave assembly or heating assembly and stirrer means are advantageously incorporated in one side of a heating chamber so as to make possible a compact size and simple construction of the heating chamber with consequent low manufacturing cost.

A further object of the present invention is to provide a microwave oven of the above described type in which the stirrer means for the microwave energy is disposed in positions approximately symmetrical with respect to a central vertical plane of the heating chamber, with said stirrer means adapted to rotate by an air flow for cooling the microwave assembly without requiring any separate drive means.

A still further object of the present invention is to provide a microwave oven of the above described type in which the stirrer means is constituted by fans of similar dimension rotatably supported on corresponding shafts of electrically conductive material, which shafts extend at right angles from a rear side wall of the heating chamber, so that electric field is concentrated on the shafts acting as antennas for better microwave energy stirring effects by the fans and also for simple construction of the stirrer means.

Another object of the present invention is to provide a microwave oven of the above described type in which blades in each of the fans are twisted or bent in the same direction, while the direction of twist of the blades in one fan is opposite from that of the other fan, with the fans disposed in positions symmetrical with respect to the central vertical plane of the heating chamber for efficient distribution of the microwave energy in the heating chamber.

In achieving these and other objects there is provided, according to the present invention, a microwave oven wherein the oven chamber or heating chamber is defined by upper and lower portions which are both generally triangular in section, the lower portion comprising the base and rear walls and lower half of the side walls of the oven chamber and being defined by an oven main casing, and the upper portion comprising the front and top walls and upper half of the side walls of the oven chamber and being formed as a concave portion in an oven door assembly which also comprises a broad rim which may fit in flat contact against a correspondingly dimensioned border provided in the main casing around the open side of the chamber lower portion, and which when in a closed position lies on an inclined plane sloping upwards from front to rear of the oven, the weight of the door assembly thus acting downwards and assisting latch means to retain the door assembly in a closed position, and the broad rim portion thereof permitting adequate provision of microwave sealing means. The door assembly is hinged at a rear edge portion thereof and may be pivoted upwards to open positions downwards to a closed position. The door assembly does not project to the front or side of the oven during opening or closing, and the oven is therefore employable in a comparatively small space. Also, since the door assembly defines the front and top walls of the oven chamber, when the door assembly is in a completely open position, the object to be heated may be inserted into the oven, or removed therefrom, from above or from the front of the oven, which is thus employable with equal convenience at a variety of levels or locations. The front and top walls of the oven chamber are provided at a suitable angle to one another to ensure that there is no collision with an object placed in the oven when the door assembly is closed, and also to contribute to even distribution of microwaves supplied into the oven chamber. At the rear of the main casing there is provided a housing containing a heating assembly including a magnetron which is supplied with power by a known means, such as a high voltage transformer. Microwaves produced by the magnetron are directed into a rear portion of the heating chamber and into contact with microwave stirrer means, which is referred to as stirrer fans or fans hereinafter. The two stirrer fans are rotatably supported on corresponding shafts of electrically conductive material, said shafts extending at right angles from the rear side wall of the heating chamber and being disposed in positions symmetrical with respect to a central vertical plane of the heating chamber for efficient distribution of the microwave energy, which fans are caused to rotate by air which is supplied into the heating assembly housing to cool the magnetron, provision of a separate fan motor thus being unnecessary, and microwaves are directed thereby into the heating chamber. The invention thus provides a sturdy, economical microwave oven which presents practically no restrictions on location thereof, since it has minimum space requirements and may be used with equal convenience at high or low levels.

Figure 2:
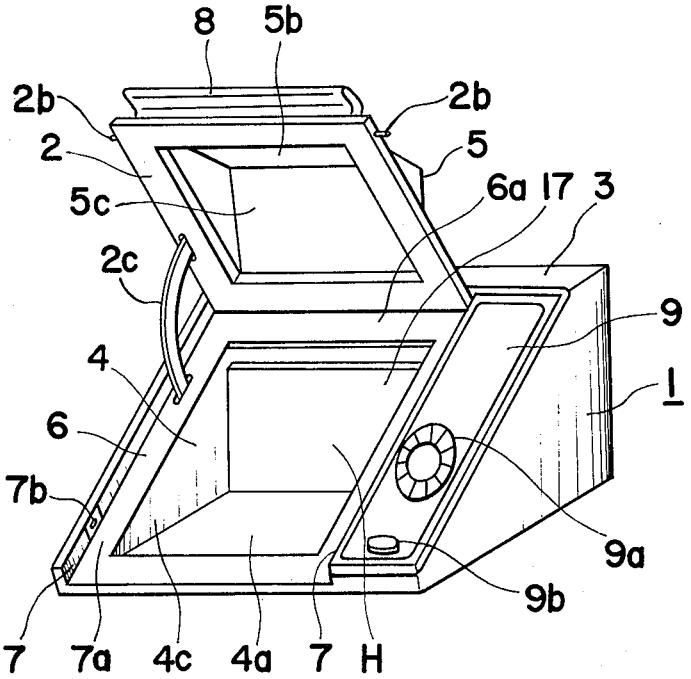
Figure 3:
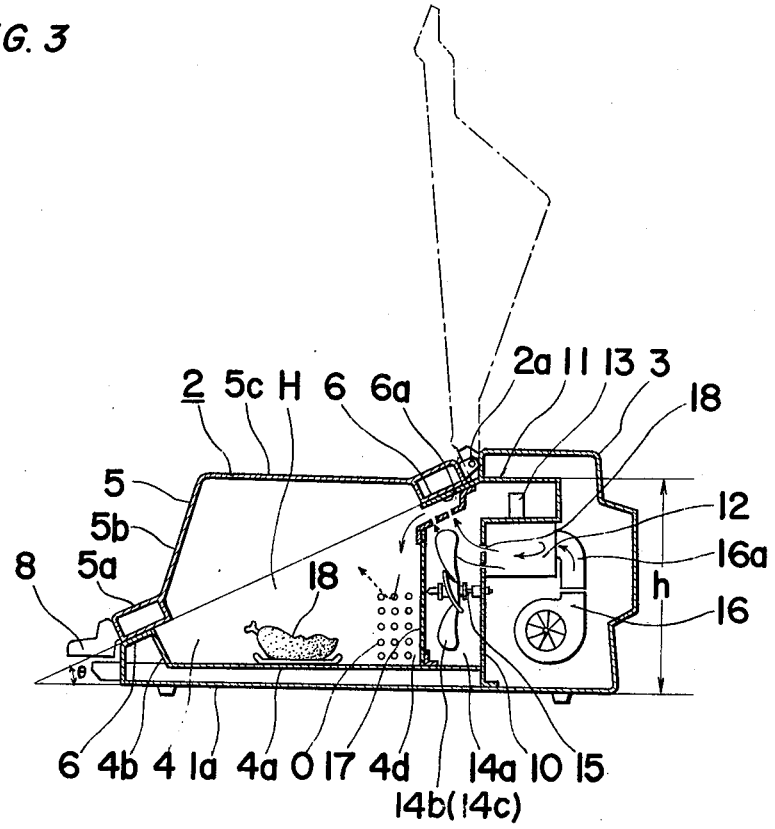
Figure 4:
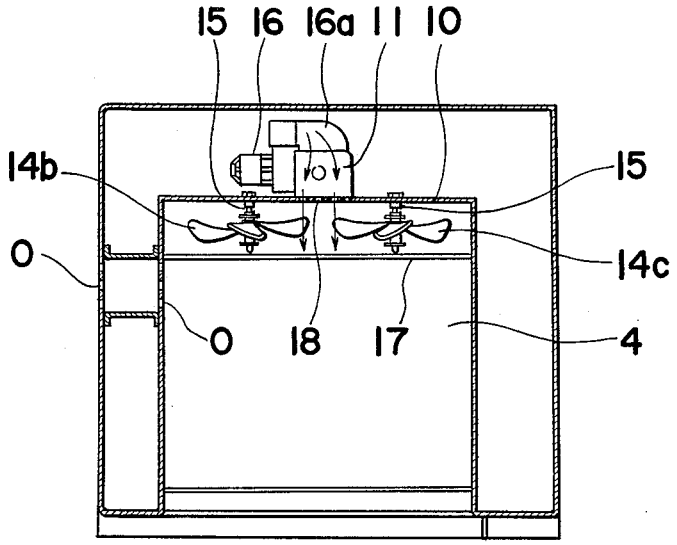
Figure 5:
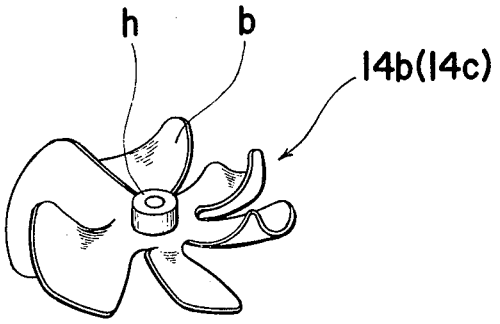
Figure 6:
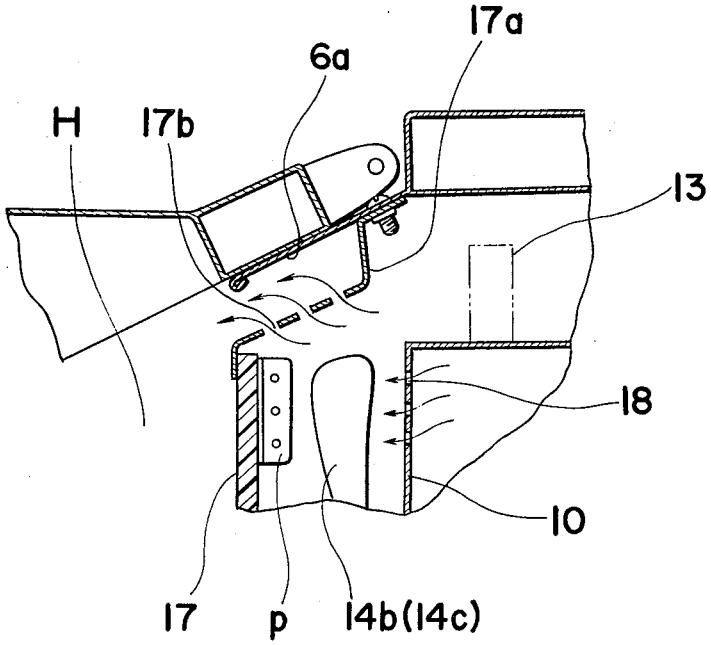
Figure 7:
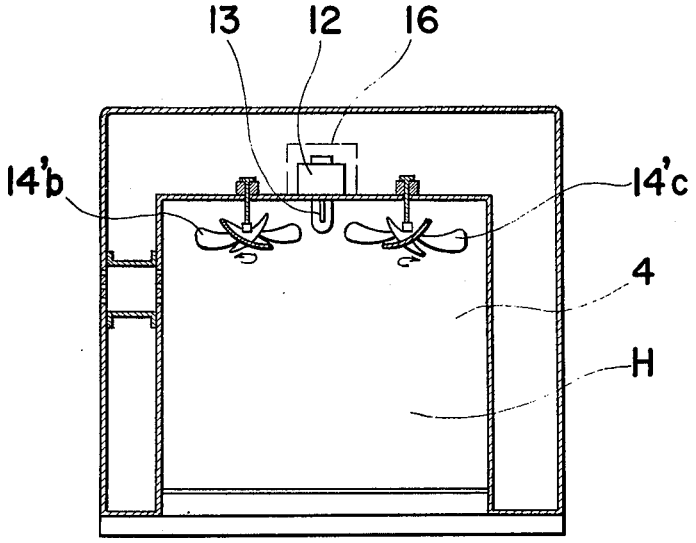
Figure 8:
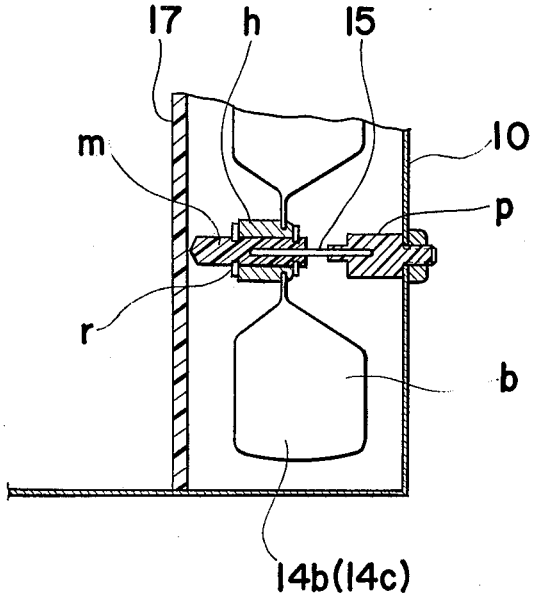

These and other objects and features of the present invention will become apparent from the following description taken in conjunction with the preferred embodiment thereof with reference to the attached drawings, in which;

FIG. 1 is a perspective view of a microwave oven according to the invention with a door assembly thereof in a closed position, FIG. 2 is a perspective view of the microwave oven of FIG. 1 with the door assembly thereof in an opened position, FIG. 3 is a front to rear cross-sectional view of the oven of FIG. 1, FIG. 4 is a horizontal cross-sectional view of the oven of the FIG. 1 showing arrangement of heating assembly and stirrer means, FIG. 5 is a perspective view showing on an enlarged scale, the construction of a stirrer fan, FIG. 6 is a cross sectional view showing, on an enlarged scale, passage of air flow at an upper rear portion in the heating chamber of the oven of FIG. 1, FIG. 7 is a similar view of FIG. 4, but particularly shows a modification thereof, and FIG. 8 is a cross sectional view showing, on an enlarged scale, another modification of the stirrer fans of the oven of FIG. 1.

Before the description of the present invention proceeds, it is to be noted that like parts are designated by like numerals throughout the several views of the accompanying drawings.

Referring to FIGS. 1 through 3, there is shown a microwave oven of the invention comprising three main portions which are main casing 1, which defines the lower portion of the oven or heating chamber H, a door assembly 2, which is movable to open or close the oven and also defines the upper portion of the heating chamber H, and a heating assembly housing 3, which has a generally rectangular box shape and is provided in fixed or integral attachment to the rear of the main casing 1. The main casing 1 preferably has a double wall structure and comprises inner walls which are suitably made of steel plate or similar material and define a lower portion 4 of the heating chamber H, these inner walls including a horizontal base 4*a* spaced from the bottom plate 1*a* of the casing 1 and vertical side walls 4*c* which have lower edges integrally attached to left and right sides of the base 4*a*, i.e., left and right sides thereof as seen facing the oven, which are equal in dimensions to one another, and each of which has the general form of a right-angle triangle. The forward edge of the base 4*a* is integrally attached to a short wall 4*b* which is inclined forwardly and upwardly away from the base 4*a*, and is at an obtuse angle to the base 4*a*. The hypoteneuse of the approximate right-angle triangle defined by each side wall 4*c* slopes upwardly and rearwardly from the forward portion of the main casing 1, and the lower, forward end thereof is truncated slightly, the lower, forward ends of the side walls 4*c* being integrally attached to opposite ends of the short wall 4*b*. The rear edge of the base 4*a* is fixed to or integrally attached to a vertical plate 10 which separates the main casing 1 and heating assembly housing 3.

Fixed to or integrally attached to the front edge of the short wall 4*b* and to the long sides of the side walls 4*c* there is provided a generally rectangular frame 6 which has comparatively broad borders and is inclined to the horizontal at the same angle as the long sides of the side walls 4*c*. The topmost border 6*a* of the frame 6 has a rear edge fixed to or integrally attached to a top portion of the front side of the heating assembly housing 3 and extends to a point which is short distance forward of the plate 10, i.e., the topmost border 6*a* constitutes a free projection extending forwardly and downwardly into the upper rear portion of the main housing 1. At least the topmost border 6*a* of the frame 6 is made of a material suitable for reflection of microwaves. Generally in line with the front edge of the frame topmost border 6*a* there is provided a vertical partition 17 which is made of a material having low permittivity, is mounted on the base 4*a*, and extends crosswise between the side walls 4*c* and upwards to a short distance below the topmost border 6*a*. Thus the heating chamber lower portion 4 has the approximate shape of a right-angle prism defined by the main portion of the base 4*a*, short wall 4*b*, side walls 4*c* and partition 17, and has an upper opening which lies on an inclined plane and is surrounded by the frame 6. Within this lower portion 4, the base 4*a*, short wall 4*b* and the bottom portion of the partition 17 define a basin 4*d*. The rear portion of the base 4*a*, the partition 17, plate 10 and the frame topmost border 6*a* generally define stirrer means housing portion 14*a* housing stirrer means or fans 14*b* and 14*c*, described later, with the partition 17 serving to protect the front portions of the fans. It should be noted here that, since the surface of the frame 6 is inclined at an angle $\theta$ to the bottom plate 1*a* of the casing 1, the height $h$ of the heating chamber lower portion 4 increases toward the rear portion, i.e., toward the vertical plate 10, thus providing sufficient space for the lower portion 4.

As best shown in FIG. 2, fixed to or integally attached to the upper outside edges of the frame 6 there are formed side frame walls 7 which are at right-angles to and extend outwards with respect to the frame 6. The frame 6 and side frame walls 7 together define a seating space 7*a* for the door assembly 2. Near the lower end of each left and right wall 7 there is formed a detent recess 7*b*, the recesses 7*b* being engageable by latches 2*b* provided on the door assembly 2. The main casing further comprises an interior portion which provides sliding accommodation for an arm 2*c* which is attached to a lower side portion of the door assembly 2 and passes through a portion of the frame 6. The door arm 2*c* may, of course, be attached to another portion of the door assembly 2 and pass through another portion of the main casing 1. The main casing 1 further comprises an outside front wall portion which is inclined upwards from front to rear of the main casing 1 at the same inclination as the frame 6, and on which there is mounted a control panel 9, carrying a timer 9*a* and start switch 9*b*, for example. The elements of the control panel 9 connect to and control elements of the assembly in the housing 3 in a known manner.

Still referring to FIGS. 1 through 3, the door assembly 2 has one edge portion connected by horizontally disposed hinges 2*a* to a top rear portion of the main casing 1, the door assembly being pivotal upwards or downwards to open or closed positions. The door arm 2*c* may be arranged to permit the door assembly 2 to be held in various positions of partial or full opening.

The door assembly 2 comprises a main rim 5*a* which has a double wall structure, defines a flat surface having dimensions equal to those of the frame 6, and has a thickness generally equal to the height of the side frame walls 7, whereby the rim 5*a* may fit exactly into the seating recess 7*a*. The abovementioned latches 2*b* extend from opposite sides of the rim 5*a*, and by engagement with the detent recesses 7*b* retain the rim 5*a* in the seating recess 7*a*, whereby the door assembly 2 may be kept closed. As noted earlier the borders of the frame 6 are comparatively broad and there is therefore a large area of contact between the rim 5*a* and frame 6, thus providing a good heat seal. As a microwave seal there is provided an attenuator coil or coils, or similar means, in the main casing 1 portion adjacent to the seating recess 7*a*, or inside the rim 5*a*, which is broad enough to accommodate suitably large attenuator means. There is also preferably provided a switch element which is, for example, mounted in the seating recess 7*a* and actuated by the rim 5*a*, and is closed only when the rim 5*a* is completely seated in the seating recess 7*a*, and which forms part of the circuit controlled by the start switch 9*b* and must be closed before this circuit can be actuated, whereby heating of the oven can be effected only when the door assembly 2 is completely closed.

The rim 5*a* carries a concave structure, which is fixed or integrally connected thereto, and comprises generally triangular side walls 5*d* and a generally rectangular front wall 5*b* and top wall 5*c*. The walls 5*b*, 5*c* and 5*d* together define a cavity which is generally triangular in section, and which, as best shown in FIG. 3, constitutes the upper portion 5 of the heating chamber H when the door assembly 2 is closed, the heating chamber lower portion 4 and upper portion 5 together constituting a generally cubic space. Either the front wall 5*b* or the top wall 5*c*, or both, may be transparent or may have formed or mounted therein viewing windows to permit the contents of the oven to be seen even when the door assembly 2 is closed. The door assembly 2 may be moved to the open or closed positions by means of a handle 8 which is attached to the front edge of the rim 5*a*.

As illustrated most clearly in FIG. 2 and in the chain line portion of FIG. 3, when the door assembly 2 is raised to an open position, the heating chamber lower portion 4 is clearly exposed and the food or object 18 may be inserted vertically into the heating chamber H, which thus offers no inconvenience of operation even if placed on the floor, or, if the oven is at a comparatively high level, the food 18 may be inserted through the front of the oven. Since no extra side-to-side or front-to-rear space is required during opening and closing movement of the door assembly 2, the oven is utilized in a space which is very little greater than the space occupied by the oven when the door assembly 2 is closed. It is also to be noted that when the door assembly 2 is in a most open position cleaning of the oven interior is extremely straightforward since the whole of the oven interior is visible and accessible.

Referring to FIG. 3 to FIG. 5, in the housing 3 there is mounted a magnetron 12 having an ouput loop 13 and supplied with power by known means, such as a high voltage transformer (not shown). Microwave output of the magnetron 12 is fed by the loop 13 into a waveguide 11, which is provided in a generally central position in the upper portion of the housing 3, is disposed horizontally and generally in line with the topmost border 6*a* of the frame 6, and directs the microwave output into the upper rear portion of the main casing 1. A portion of the housing 3 defines an air duct 16*a* via which air to cool the magnetron 12 may pass, cooling air being driven through the duct 16*a* by a blower 16 provided in the housing 3 near the magnetron 12, as best shown in FIG. 3. Before exiting from the oven, cooling air must pass through the fan housing portion 14*a* defined between the plate 10, partition 17 and rear portion of the base 4*a*, entry of air into the fan housing portion 14*a* being permitted by suitably disposed openings 18 formed in the upper portion of the plate 10.

As shown in FIG. 5, each of the two fans 14*b* and 14*c* has the same dimensions and has blades *b* made of a material suiitable for reflection of microwaves, and is rotatably mounted at the hub *h* thereof on a shaft 15 which is horizontal and fixedly mounted on the forward side of the plate 10.

It should be noted here that the shafts 15, and consequently the fans 14*b* and 14*c* are disposed in positions symmetrical with respect to the central vertical plane of the waveguide 11 or from the from to there or of the heating chamber H.

It should also be noted that, in each of the fans 14*b* and 14*c*, the blades *b* thereof are twisted or bent in the same direction as in FIG. 5, whereas the direction of twist of the blades *b* in the fan 14*b* is opposite from that of the blades in the other fan 14*c*. By twisting or bending the blades *b* of each of fan in the same direction, the pressure of air flow in the direction of the axis of the hub *h* of the fan imparts an identical couple of rotational force to each of the blades *b*, while the arrangement that the direction of twist of the blades *b* of the one fan 14*b* is opposite from that of the other fan 14*c* is effective for symmetrically distributing the electric field with respect to the central vertical plane of the heating chamber H. Air flow passing through an air duct 16*a* from the blower 16 is directed into the housing portion 14*a* through the openings 18 formed in the plate 10 after having cooled the magnetron 12 as shown by the arrows in FIG. 3, and causes the fans 14*b* and 14*c* to rotate, thus there being no necessity for provision of a separate fan motor or the like.

The present invention confirmed through a series of experiments that, by the above arrangement, the heating chamber H is perfectly symmetrical with respect to the vertical axis of the output loop 13 of the magnetron 12 for effective microwave energy radiation, with distribution of electric field in the heating chamber H also being symmetrical.

Referring now to FIG. 6 showing the passage of air flow in the heating chamber H of the oven of FIG. 3 on an enlarged scale, the top edge of the partition plate 17 is connected to the top rear edge of the frame 6, i.e., to the rear part of the under surface of the topmost border 6*a* by a shaped connector plate 17*a* which is made of metal or of a material having low permittivity similar to that of the partition plate 17 and the upper rear edge of which is secured to the topmost border 6*a* by securing screws as shown. The inclined intermediate portion of the connector plate 17*a* has many openings 17*b* therein for air passage, through which openings 17*b*, the air flow from the blower 16 is introduced into the heating chamber H after turning the fans 14*b* and 14*c*, and subsequently drives vapor or the like generated from the object 18 during heating out of the heating chamber H through openings O suitably formed in the side wall 4*c* as shown in FIG. 3. It should be noted here that another connector plate *p* of triangular cross section may be provided between one side edge of the partition plate 17 and the side wall 4*c* and suitably fixed to the plate 17 and the wall 4*c* for holding the plate 17 in position more securely as shown. In the above arrangement, since the air passage openings 17*b* formed in the inclined portion of the connector plate 17*a* are hardly noticable as seen from the front of the heating chamber H, the tidy appearance of the inside of the heating chamber H is not spoiled. Furthermore, the provision of the openings 17*b* in the upper innermost portion of the heating chamber H advantageously prevents splashes or the like from the object 18 during heating from entering the fan housing 14*a* or the microwave assembly. By this arrangement, when the door assembly 2 is closed and the start switch 9*b* is turned on, microwaves produced by the magnetron 12 and directed into the upper rear portion of the main casing 1 meet the under surface of the topmost border 6*a* of the frame 6 and are reflected thereby in a generally downward direction, most of the microwaves thus reflected being directed into the fan housing portion 14*a*, where they impinge on the fans 14*b* and 14*c*. Simultaneously with start of actuation of the magnetron 12, the blower 16 is started, and air passing through the duct 16*a* to cool the magnetron 12 also causes rotation of the fans 14*b* and 14*c*, which therefore direct the microwaves in a divergent manner into the heating chamber H. Since the front wall 5*b* and top wall 5*c* are at an obtuse angle to one another, any microwaves impinging thereon tend to be distributed in a generally downward direction after no more than one or two reflections and concentrated upon the object 18 to be heated, thus causing efficient heating of the object 18 supported on the base 4*a*, which arrangement is one of the most outstanding features of the microwave oven of the invention. If the object in the oven is, for example, a liquid which may overflow upon being heated, any liquid which overflows is retained in the chamber basin 4*d*, and is prevented by the sloping short wall 4*b* from leaking between the rim 5*a* of the door assembly 2 and frame 6 of the main casing 1. Also, provision of the short wall 4*b* at an obtuse angle to the base 4*a* further facilitates cleaning of the oven interior.

Referring to FIG. 7, there is shown a modification of the microwave oven of FIGS. 3 and 4. In this modification, the partition plate 17 described as employed in FIGS. 3 and 4 is dispensed with, and the output loop 13 of the magnetron 12 is directly coupled and projected into the heating chamber H with fans 14*b*′ and 14*c*′ disposed in positions symmetrical with respect to the axis of the output loop 13, by which arrangement also, a similar effect for microwave energy distribution to that in the embodiment of FIGS. 3 and 4 can be achieved.

Referring now to FIG. 8, there is shown another modification of the microwave oven of FIGS. 3 and 4. In this modification, each of the blades *b* of each fan 14*b* or 14*c* is secured to the hub *h* of an electrically conductive material, and the shaft 15 of a similar conductive material extending horizontally at right angles from the forward surface of the vertical plate 10 is fixedly received in a pedestal *p* of a low permittivity material suitably secured to the plate 10. The hub *h* of the fan 14*b* or 14*c* is fixedly received in a spacer member *m* of a low permittivity material through a securing ring *r*, which spacer member *m* is rotatably supported by the shaft 15, thus permitting the fan 14*b* or 14*c* to rotate freely about the shaft 15. The forward end of the spacer member *m* is formed into a conical shape having an acute core angle, which forward end is adapted to contact the surface of the partition plate 17 for preventing the fan 14*b* or 14*c* from coming off the shaft 15. It should be noted here that the forward end of the shaft 15 is received in the portion of the spacer member *m* located in the hub *h* of each of the fans 14*b* and 14*c* for stably supporting the fan. Since the hub *h* and the shaft 15 are coaxially arranged, both serving as an outer conductive member and an inner conductive member, the electric field is approximately uniformly distributed over each of the shafts 15. In other words, by the above arrangement, such inconveniences as spark discharge at the ends of the shafts 15 due to abnormal electrostatic focusing or deformation of the spacer members *m* due to heat can advantageously be eliminated, with the electric field simultaneously concentrated on the entire shafts 15 which act as antennas. Accordingly, the microwave energy can be distributed in various directions by the blades *b* of the fans 14*b* and 14*c* through the hubs *h* which are coaxially and electrostatically coupled to the shafts 15, so that extremely favorable electric field distribution can be obtained. Moreover, since each of the shafts 15 is made of an electrically conductive material, such as metal, the former can be formed with a rod of small diameter which will support the weight of the fan, thus making it possible to reduce the contact area between the spacer member *m* and the shaft 15 to a minimum, with consequent less friction therebetween and smooth rotation of the fans. Furthermore, in the above arrangement, since the center of gravity of the fan 14*b* or 14*c* is located at the bearing portion of the shaft 15, resistance against rotation at such bearing portion is very small, thus further contributing to smooth rotation of the fans. Moreover, since the fans 14*b* and 14*c* are received merely by the shaft, assembling thereof in manufacturing or disassembling of the same for maintenance is very readily carried out with consequent low cost.

It should be noted here that the construction of the fan assembly is not limited to the modification of FIG. 8, but may be further modified within the scope of the invention. For example, the hub *h* and the spacer member *m* described as separate in the modification of FIG. 8 may be formed integrally with the same material to which the blades *b* are directly secured, and which is rotatably supported by the shaft for further simplification of the construction. Similarly, although two stirrer fans are described as employed in the embodiment of the invention, the number of such fans may be increased to more than two, provided that these fans are disposed in positions in the heating chamber symmetrical with respect to the central vertical plane of the heating chamber for efficient distribution of the microwave energy.

As is clear from the foregoing descriptions, the microwave oven of the invention offers the advantages of compact and simple construction with efficient distribution of microwave energy into the heating chamber by the employment of special microwave reflecting and stirrer means, safe and economical operation through perfect and enduring microwave sealing means, minimum space requirements and complete facility of use, even though placed at different levels, by the novel door arrangements. The provision of the fans for microwave dispersion, which fans are disposed in positions symmetrical with respect to the vertical plane of the output loop of the magnetron, is very effective for advantageously distributing microwave energy into the heating chamber without requiring any separate driving power soruce, and consequently for efficiently heating the object in the heating chamber. Furthermore, the simple construction of the fan assembly contributes to accurate functioning and long life of the oven to a great extent with reduction in manufacturing cost.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. In a microwave oven having a main casing portion defining an open base and lower portion of a heating chamber, and including at least one flat mating surface which is defined by borders of a frame member for said main casing portion and which is inclined at an acute angle with respect to said base, a door assembly portion which defines a heating chamber upper portion which is complementary to said lower portion and which cooperates therewith to define a complete heating chamber, said door assembly being movable to and held at a closed position wherein said door assembly portion seals, said heating chamber, said door assembly being movable pivotally, upwardly to an open position, a heating assembly including high frequency wave generation means, for directing waves generated by said generation means into said main casing portion, power supply means for supplying electrical power to said generation means, blower means for cooling said heating assembly, and a housing portion for housing said heating assembly, the improvement comprising a plurality of stirrer means for stirring said high frequency waves, said stirrer means being rotatably disposed on one side wall in said heating chamber with equal parts of the plurality of stirrer means being in positions approximately symmetrical with respect to a central front to rear plane of said heating chamber and being rotated by the air flow caused by said blower means.

2. A microwave oven as claimed in claim 1 wherein there is further provided a partition plate member of low permittivity material, said partition plate member being disposed in front of said one side wall in spaced relation to the latter to provide a housing portion for said stirrer means therebetween, at least one side edge of said partition plate member being secured to walls defining said heating chamber and a shaped connection member secured between another side edge of said partition plate and a frame member of said heating chamber, said shaped connector member being provided with openings for air flow passage at a portion thereof located between said partition plate and said frame member.

3. A microwave oven as claimed in claim 1 wherein said stirrer means comprises a plurality of stirrer fans rotatably disposed on said one side wall in said heating chamber with equal parts of the plurality of stirrer fans being in the positions approximately symmetrical with respect to said central plane of said heating chamber, said heating assembly including air flow directing means for detecting said air flow to a position approximately midway between said plurality of stirrer fans for rotation thereof.

4. A microwave oven as claimed in claim 3, wherein each of said stirrer fans has a hub portion, and a shaft member of electrically conductive material is provided for each stirrer fan and rotatably supports the hub portion thereof, at least one end of each shaft member being secured to said one side wall of said heating chamber.

5. A microwave oven as claimed in claim 4, wherein said hub portion of each of said stirrer fans has a spacer member thereon, and said oven further has a partition plate member of low permittivity material, said partition plate member being disposed in front of said one side wall in spaced relation thereto to provide a housing portion for said stirrer fans, one end of said spacer member remote from said shaft member being in contact with said partition plate member for keeping said fan in position on said shaft member.

6. A microwave oven as claimed in claim 3, wherein each of said stirrer fans has a hub portion of electrically conductive material, and a shaft member of electrically conductive material is provided for each stirrer fan and which is secured to said one side wall of said heating chamber at least at said one end of said shaft member, and a spacer member of dielectric material on the other end of said shaft member on which the corresponding hub portion is mounted.

7. A microwave oven as claimed in claim 3, wherein said high frequency generation means is disposed in a position approximately in line with said central plane of said heating chamber and there being at least a pair of said stirrer fans with one disposed in symmetrical positions on opposite sides of said central plane, each of said stirrer fans in said pair having blades of microwave reflecting material twisted in the same direction, with direction of twist of blades on one of said fans in said pair being opposite to that of blades on the other of said fans in said pair.

* * * * *